US009663987B2

(12) United States Patent
Huang et al.

(10) Patent No.: US 9,663,987 B2
(45) Date of Patent: May 30, 2017

(54) WINDOW SHADE AND CONTROL SYSTEM THEREOF

(71) Applicant: TEH YOR CO., LTD., Taipei (TW)

(72) Inventors: Chin-Tien Huang, New Taipei (TW); Fu-Lai Yu, New Taipei (TW)

(73) Assignee: TEH YOR CO., LTD. (TW)

( * ) Notice: Subject to any disclaimer, the term of this patent is extended or adjusted under 35 U.S.C. 154(b) by 0 days.

(21) Appl. No.: 14/941,833

(22) Filed: Nov. 16, 2015

(65) Prior Publication Data

US 2016/0208551 A1 Jul. 21, 2016

(30) Foreign Application Priority Data

Jan. 20, 2015 (TW) ..... 104101854 A

(51) Int. Cl.
*E06B 9/322* (2006.01)
*E06B 9/60* (2006.01)
(Continued)

(52) U.S. Cl.
CPC ..... *E06B 9/322* (2013.01); *E06B 9/56* (2013.01); *E06B 9/60* (2013.01); *E06B 9/68* (2013.01);
(Continued)

(58) Field of Classification Search
CPC .. E06B 9/322; E06B 9/368; E06B 2009/3227; E06B 2009/3222; E06B 2009/3225
(Continued)

(56) References Cited

U.S. PATENT DOCUMENTS 6,076,587 A * 6/2000 Pastor ..... E06B 9/307 160/115
7,281,562 B2 * 10/2007 Huang ..... E06B 9/322 160/168.1 P
(Continued)

FOREIGN PATENT DOCUMENTS

EP 1637693 A1 3/2006
EP 2620583 A2 7/2013
TW 201315888 A1 4/2013

OTHER PUBLICATIONS

The search report in co-pending PCT Patent Application No. PCT/US2015/60823, dated Jun. 3, 2016.
(Continued)

*Primary Examiner* — Blair M Johnson
(74) *Attorney, Agent, or Firm* — David I. Roche; Baker & McKenzie LLP

(57) ABSTRACT

A control system for a window shade includes a suspension member, a first and a second casing portion, a rotary drum, a torsion spring, a coupling member, a transmission axle, a central gear, a ring and planetary gears. The rotary drum is pivotally connected with the first casing portion, and is rotatable to wind and unwind the suspension member. The torsion spring can bias the rotary drum for winding the suspension member, and has a first and a second end respectively affixed with the second casing portion and a coupling member. The transmission axle is disposed through the torsion spring, and is rotationally coupled with the rotary drum and the central gear. The ring is affixed with the second casing portion and has protruding teeth. The planetary gears are pivotally supported by the coupling member, and are respectively meshed with the central gear and the teeth of the ring.

17 Claims, 8 Drawing Sheets

(51) Int. Cl.
*E06B 9/56* (2006.01)
*E06B 9/68* (2006.01)

(52) U.S. Cl.
CPC ..... *E06B 2009/3222* (2013.01); *E06B 2009/3227* (2013.01)

(58) Field of Classification Search
USPC ..... 160/170
See application file for complete search history.

(56) References Cited

U.S. PATENT DOCUMENTS

2003/0075404 A1* 4/2003 Takahashi ..... E06B 9/80 188/290
2003/0221799 A1* 12/2003 Cross ..... E06B 9/322 160/168.1 P
2005/0056383 A1* 3/2005 Huang ..... E06B 9/322 160/170
2007/0261798 A1* 11/2007 Hung ..... E06B 9/322 160/170
2013/0248125 A1* 9/2013 Lin ..... E06B 9/262 160/84.05
2013/0340951 A1 12/2013 Yu et al.
2014/0083630 A1* 3/2014 Wu ..... E06B 9/322 160/84.04
2014/0144596 A1 5/2014 Wu et al.
2016/0222725 A1* 8/2016 Morris ..... E06B 9/262

OTHER PUBLICATIONS

English translation of Abstracts for EP 2620583 and EP 1637693.
The Office Action issued on Sep. 12, 2016 in corresponding TW Patent Application No. 104101854.
English Translation of the Abstract for TW 201315888.

* cited by examiner

WINDOW SHADE AND CONTROL SYSTEM THEREOF

CROSS-REFERENCE TO RELATED APPLICATION(S)

This patent application claims priority to Taiwan Patent Application No. 104101854 filed on Jan. 20, 2015, which is incorporated herein by reference.

BACKGROUND

1. Field of the Invention

The present invention relates to window shades, and actuating systems used in window shades.

2. Description of the Related Art

Many types of window shades are currently available on the market, such as Venetian blinds, roller shades and honeycomb shades. The shade when lowered can cover the area of the window frame, which can reduce the amount of light entering the room through the window and provide increased privacy. Conventionally, the window shade is provided with an operating cord that can be actuated to raise or lower the window shade. More specifically, a drum may be operably rotated to wind and unwind a suspension cord to respectively raise and lower the shade.

However, the operating cord used in certain traditional window shade may have an excessive length, which affects the outer appearance of the window shade. Moreover, there is a risk of child strangle on the longer operating cord. To avoid the risk of accidental injuries, some window shades have no operating cord, and an operator can directly adjust the expansion of the window shade by vertically displacing a bottom rail of the window shade. This approach generally uses torsion springs to sustain the weight of the bottom rail, which requires the manufacturer to have a stock of different spring lengths for accommodating different sizes of window shades. The need to have different spring parts may increase the manufacture cost.

Therefore, there is a need for a window shade that is simple to operate, and address or improve at least the foregoing issues.

SUMMARY

The present application describes a window shade and a control system for use with the window shade that can overcome the aforementioned problems of the prior art.

In one embodiment, the control system includes a suspension member, a first and a second casing portion, a rotary drum, a torsion spring, a coupling member, a transmission axle, a central gear, a ring and a plurality of planetary gears. The rotary drum is pivotally connected with the first casing portion and is affixed with the suspension member, the rotary drum being rotatable to wind and unwind the suspension member. The torsion spring is operable to bias the rotary drum in rotation for winding the suspension member, the torsion spring having a first and a second end, the first end being affixed with the second casing portion, and the second end being affixed with a coupling member. The transmission axle is disposed through the torsion spring, and is rotationally coupled with the rotary drum and the central gear. The ring is affixed with the second casing portion and has a plurality of teeth. The planetary gears are respectively connected pivotally with the coupling member, the planetary gears being respectively meshed with the central gear and the teeth of the ring.

In another embodiment, the control system for a window shade includes a suspension member, a first and a second casing portion, a rotary drum pivotally connected with the first casing portion and affixed with the suspension member, the rotary drum being rotatable to wind and unwind the suspension member, a torsion spring assembled coaxial to the transmission axle and having a first and a second end, a transmission axle passing through the torsion spring and rotationally coupled with the rotary drum, and a speed reducer. The first end of the torsion spring is affixed with the second casing portion, the second end of the torsion spring is connected with the speed reducer, and the torsion spring is operable to bias the rotary drum in rotation for winding the suspension member. The speed reducer is connected with the transmission axle, and includes a plurality of gears configured to convert rotational movement of the transmission axle and the rotary drum to a slower displacement of the second end of the torsion spring.

Advantages of the control system and window shade described herein include the ability to provide a speed reducer operable to adapt a fixed working range of the torsion spring to a greater displacement range of the bottom part, which can solve the problem of insufficient spring length.

DETAILED DESCRIPTION OF THE EMBODIMENTS

Figure 1:
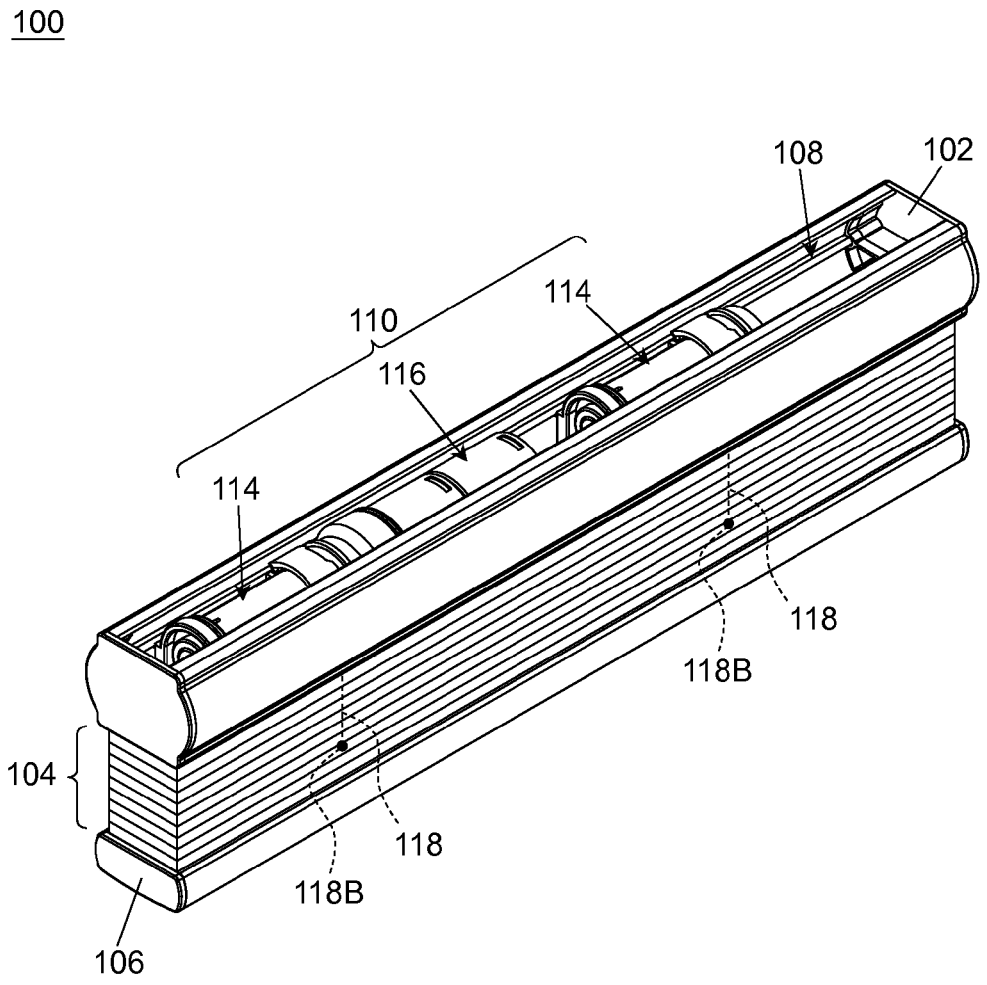
FIG. 1 is a schematic view illustrating an embodiment of a window shade.
Figure 2:
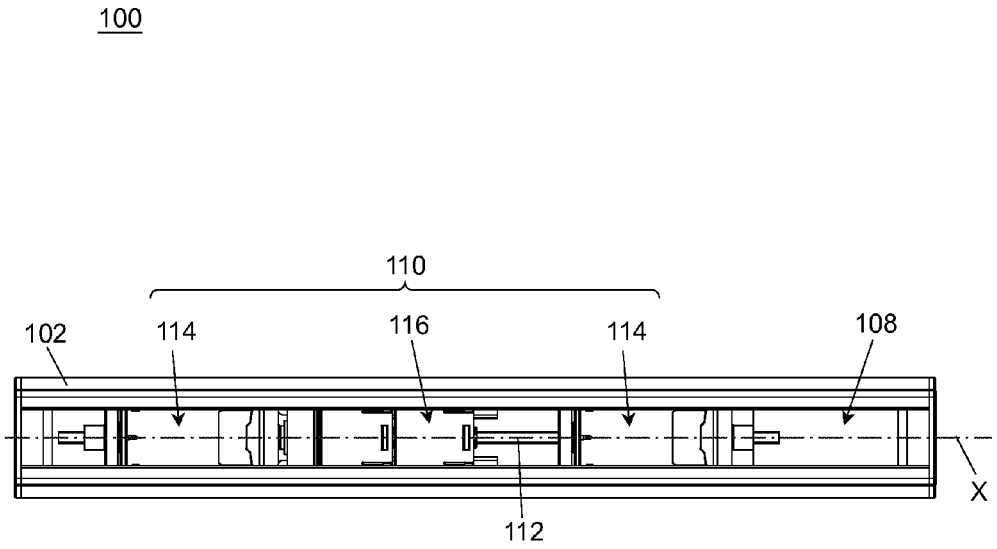
FIG. 2 is top view of the window shade shown in FIG. 1.
Figure 3:
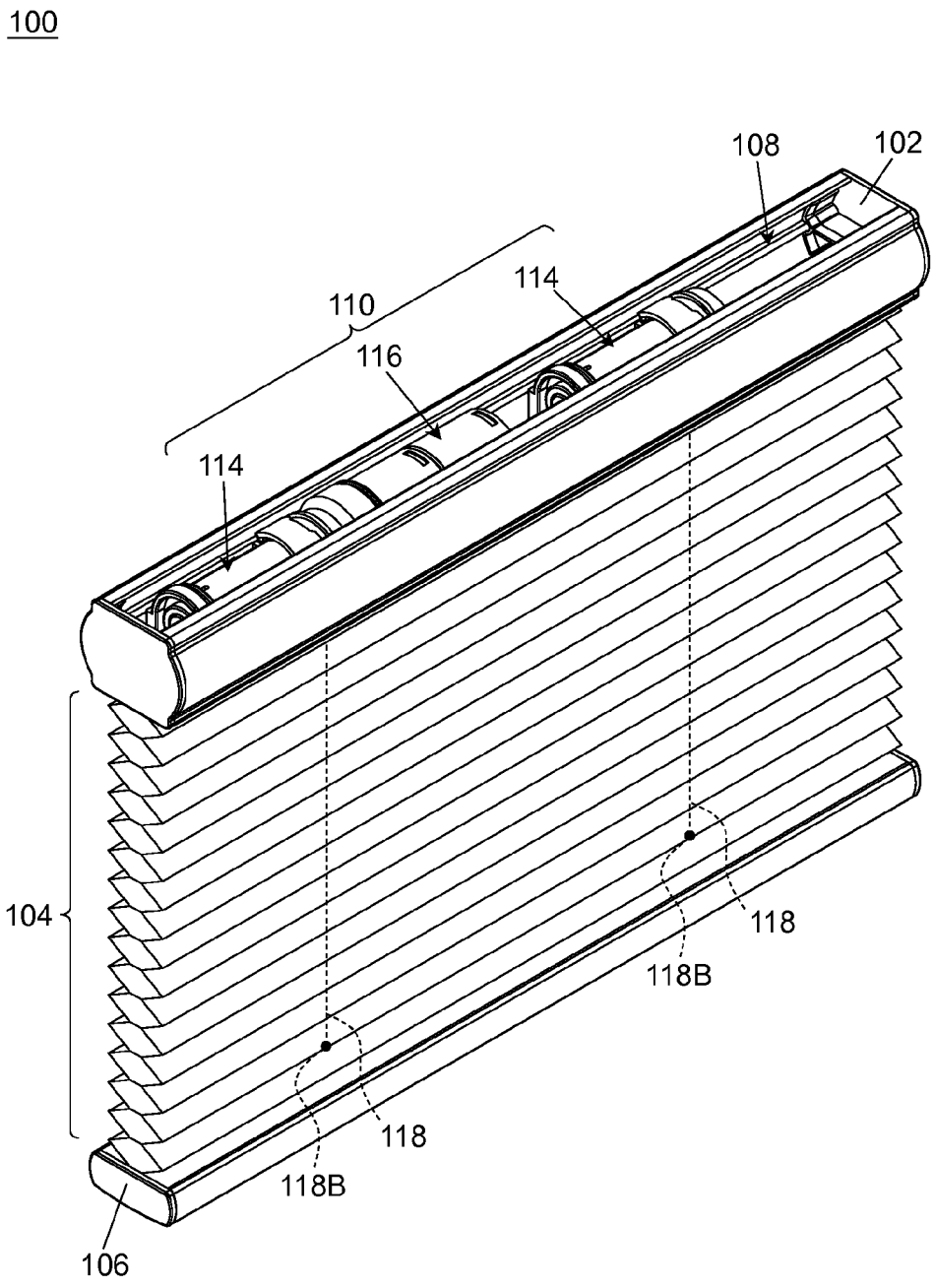
FIG. 3 is a schematic view illustrating the window shade of FIG. 1 in a fully lowered or expanded state.

FIG. 1 is a schematic view illustrating an embodiment of a window shade 100, FIG. 2 is a top view of the window shade 100, and FIG. 3 is a schematic view illustrating the window shade 100 in a fully lowered or expanded state. The window shade 100 can include a head rail 102, a shading structure 104 and a bottom part 106 disposed at a lower end of the shading structure 104. The head rail 102 can be of any type, and can have any shape. The head rail 102 can be affixed at an upper region of a window frame, and the shading structure 104 and the bottom part 106 can be suspended from the head rail 102. Moreover, the head rail 102 can have an inner cavity 108 in which is assembled a control system 110. The window shade 100 is a cordless window shade, i.e., it has no operating cords exposed outward, and the expansion and collapse of the window shade 100 can be directly adjusted by manually displacing the bottom part 106 vertically upward and downward. While the bottom part 106 is positioned at any desired height, the control system 110 can apply a biasing force suitable to keep the bottom part 106 of the shading structure 104 stationary.

The shading structure 104 can have any adequate structure. For example, the shading structure 104 can have a honeycomb structure made of a fabric material (as shown), a Venetian blind structure, or multiple horizontal slats distributed vertically.

The bottom part 106 is arranged at a lower end of the window shade 100, and can move up and down relative to the head rail 102 to collapse and expand the shading structure 104. In one embodiment, the bottom part 106 can be an elongated rail. However, the bottom part 106 can be any suitable weight member. In some embodiments, the bottom part 106 can be a lowermost end of the shading structure 104.

Figure 4:
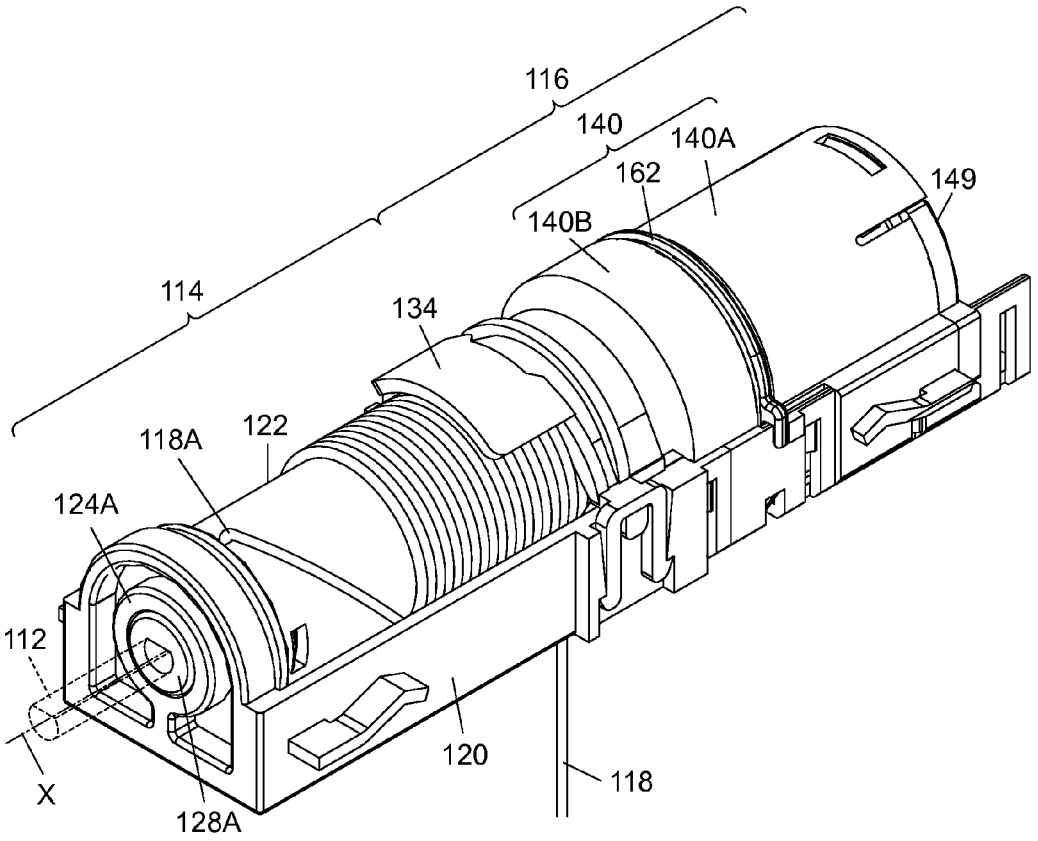
FIG. 4 is a perspective view illustrating an assembly of a winding unit and a spring drive unit used in the window shade shown in FIG. 1.

The control system 110 disposed in the head rail 102 can include a transmission axle 112, one or more winding unit 114, one or more spring drive unit 116, and one or more suspension member 118 (shown with phantom lines) respectively coupled with the winding unit 114. In one embodiment, multiple suspension members 118 may be provided as suspension cords extending vertically between the head rail 102 and the bottom part 106. Each of the suspension members 118 can have a first end 118A connected with one corresponding winding unit 114 (as shown in FIG. 4), and a second end 118B connected with the bottom part 106. When the bottom part 106 rises, the winding units 114 can respectively wind the suspension members 118. When the bottom part 106 lowers, the suspension members 118 can respectively unwind from the winding units 114. The transmission axle 112 can extend along a length of the head rail 102 and define a longitudinal axis X, and the winding units 114 and the spring drive units 116 can be axially connected with the transmission axle 112. The spring force applied by each of the spring drive units 116 can be transmitted via the transmission axle 112 to the winding units 114, so that the winding units 114 can be spring-biased in rotation for respectively winding the suspension members 118. Moreover, when the bottom part 106 is placed in a desired position, the spring force of the spring drive units 116, the weight suspended from the suspension members 118 and internal friction forces of the control system 110 can counteract one another to maintain the bottom part 106 stationary.

Figure 5:
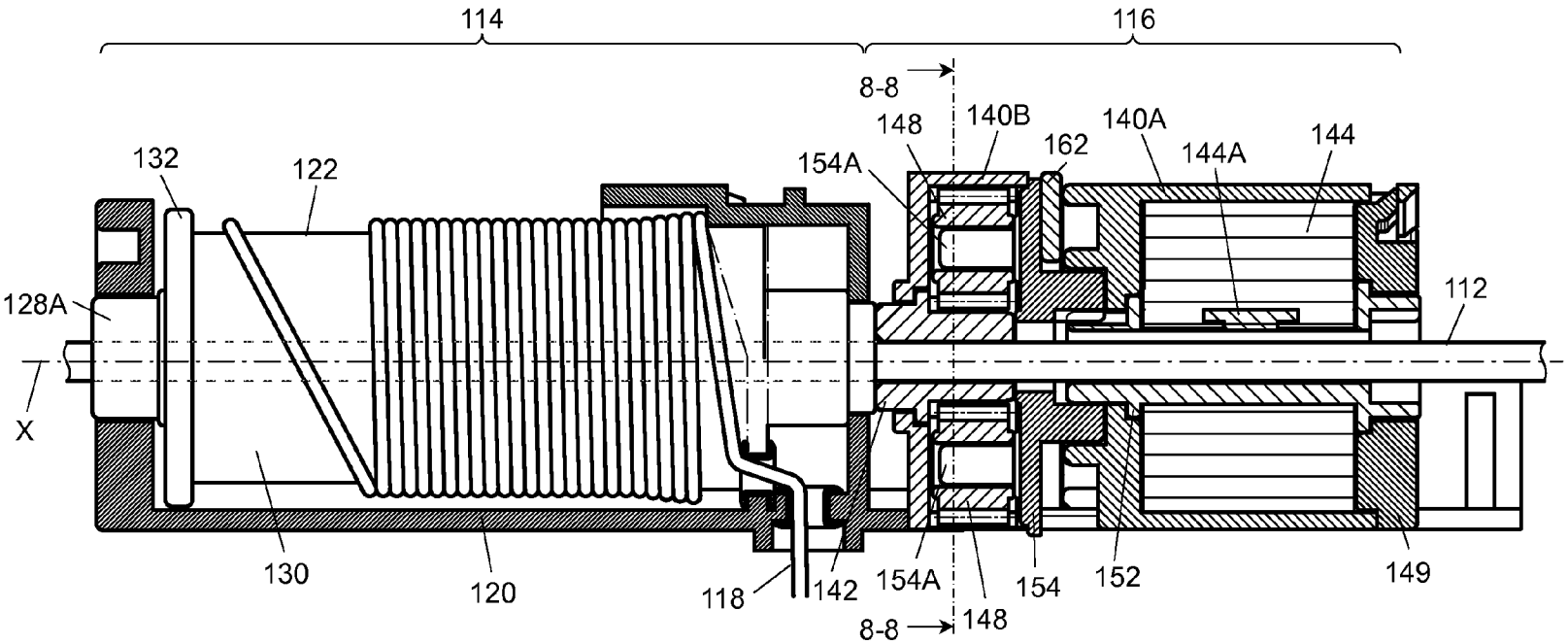
FIG. 5 is a partial cross-sectional view illustrating the winding unit and the spring drive unit of FIG. 4.
Figure 6:
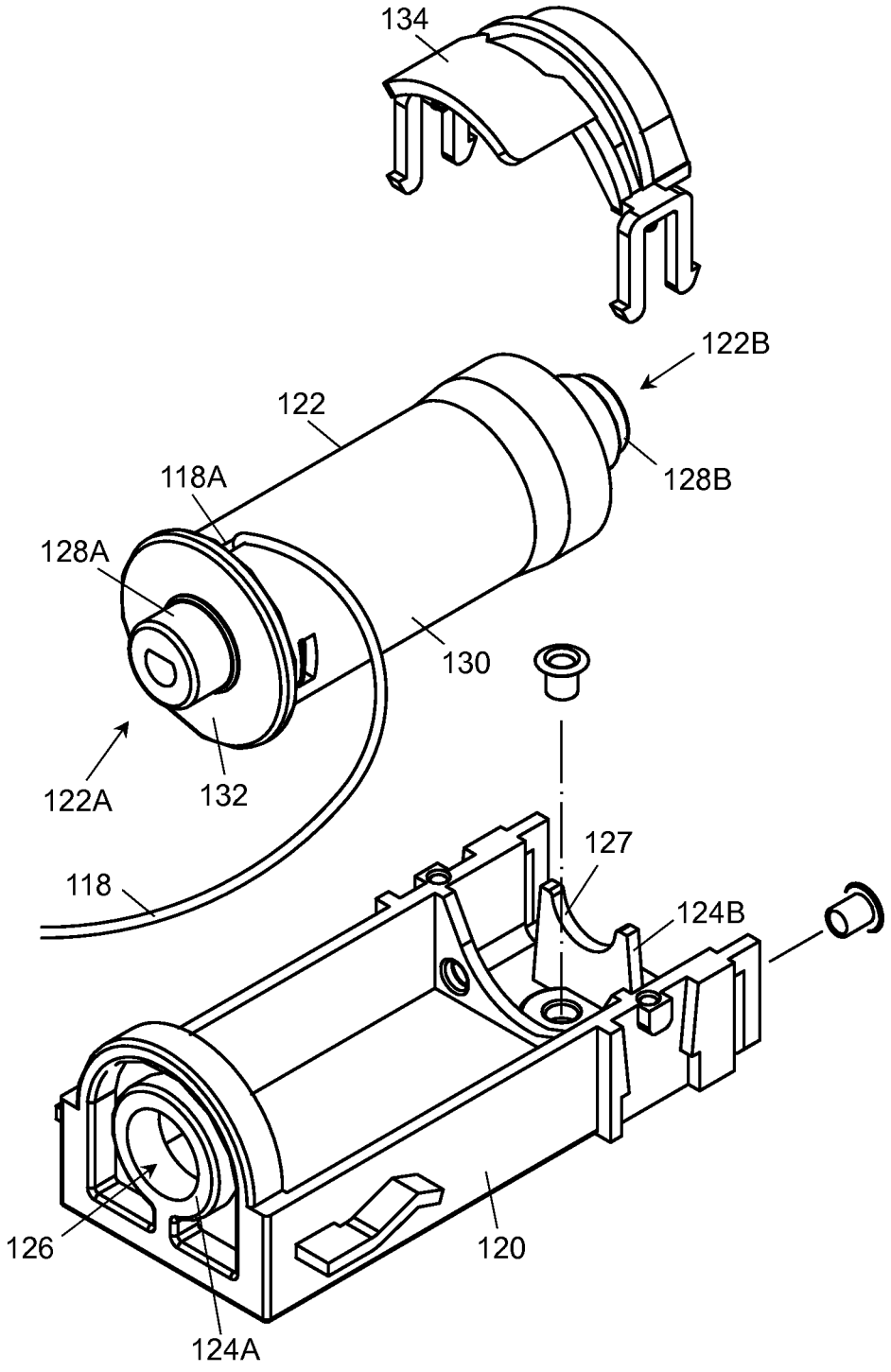
FIG. 6 is an exploded view of the winding unit shown in FIG. 4.
Figure 7:
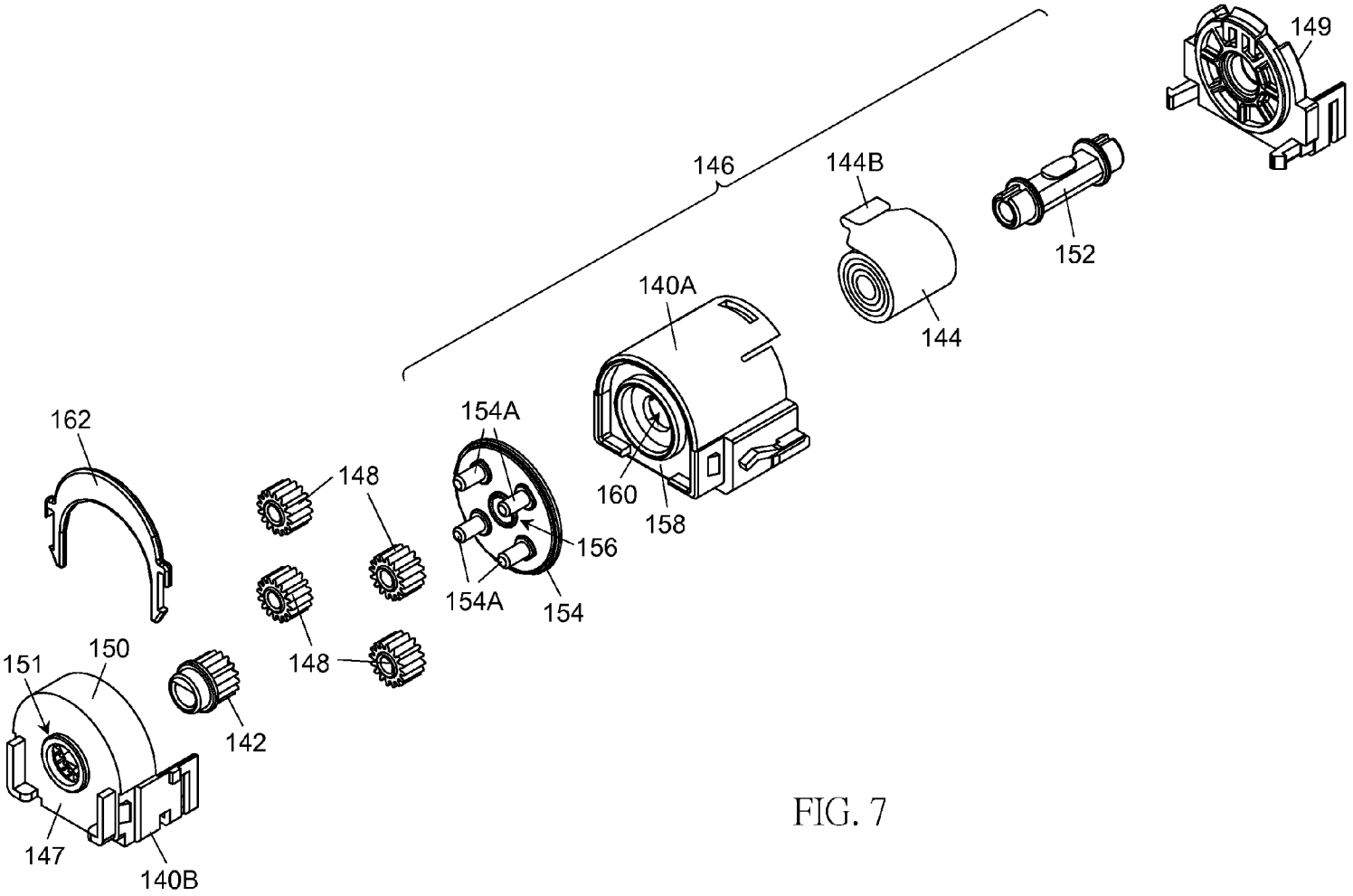
FIG. 7 is an exploded view of the spring drive unit shown in FIG. 4.
Figure 8:
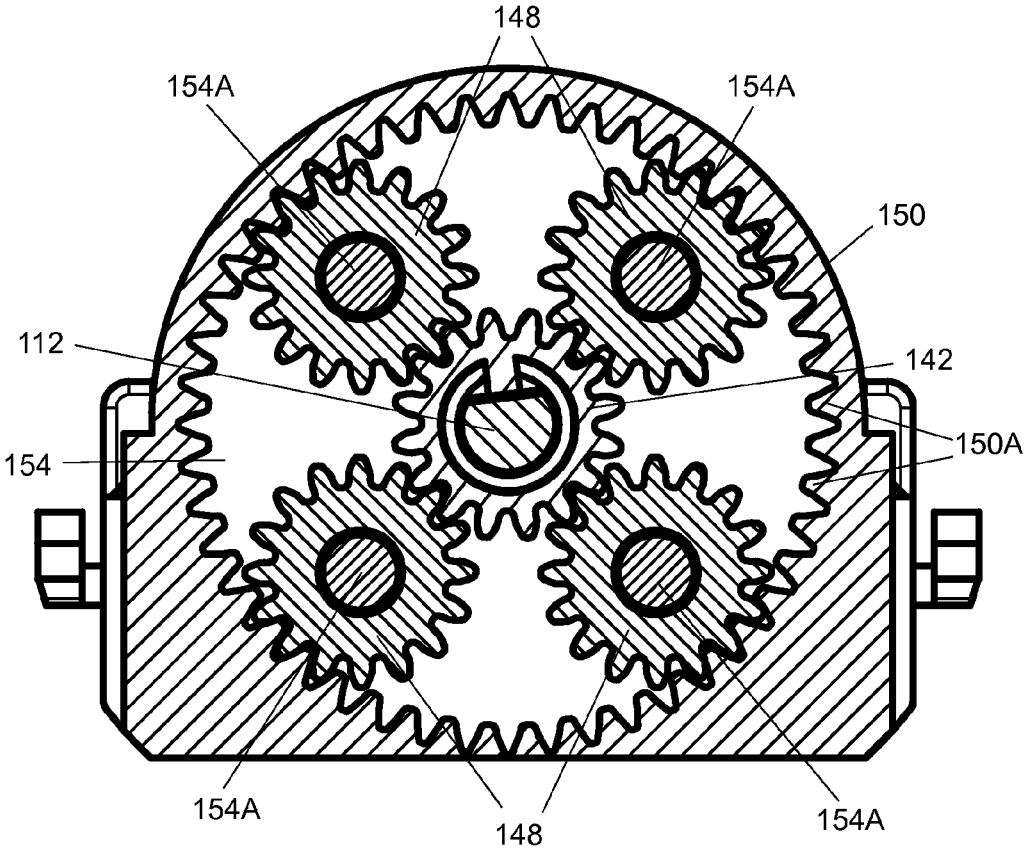
FIG. 8 is a cross-sectional view taken along section 8-8 shown in FIG. 5.

FIG. 4 is a perspective view illustrating an assembly of one winding unit 114 with one spring drive unit 116. FIG. 5 is a partial cross-sectional view illustrating the winding unit 114 and the spring drive unit 116. FIG. 6 is an exploded view of the winding unit 114. FIG. 7 is an exploded view of the spring drive unit 116. FIG. 8 is a cross-sectional view taken along section 8-8 shown in FIG. 5. Referring to FIGS. 4-6, the winding unit 114 can include a casing portion 120 and a rotary drum 122. The casing portion 120 can be affixed in the head rail 102. The casing portion 120 can have a plurality of sidewalls 124A and 124B, the sidewall 124A having a hole 126, and the sidewall 124B being formed with a pivotal support surface 127.

The rotary drum 122 is assembled in the casing portion 120, and can have two opposite sides 122A and 122B respectively provided with projecting shaft portions 128A and 128B. The shaft portion 128A can pass through the hole 126, and the shaft portion 128B can be disposed on the pivotal support surface 127, such that the rotary drum 122 is pivotally connected with the casing portion 120 about the longitudinal axis X. An outer surface 130 of the rotary drum 122 can be adapted to wind one suspension member 118, which can have its first end 118A affixed with the rotary drum 122 near the side 122A thereof. Moreover, a stop ring 132 can be affixed with the rotary drum 122 close to the side 122A, the stop ring 132 abutting the sidewall 124A. The transmission axle 112 extends through the casing portion 120 and an interior of the rotary drum 122, and is rotationally coupled with the rotary drum 122. Accordingly, the rotary drum 122 and the transmission axle 112 can rotate in unison for winding and unwinding the suspension member 118, the suspension member 118 winding around the outer surface 130 of the rotary drum 122 from the side 122B toward the side 122A. Once the rotary drum 122 is disposed in the casing portion 120, an upper cover 134 can affixed with the casing portion 120 to enclose at least partially the rotary drum 122.

Referring to FIGS. 4-8, the spring drive unit 116 can include a casing portion 140, a central gear 142, a torsion spring 144, a coupling member 146, a plurality of planetary gears 148 and a ring 150. The casing portion 140 can be disposed in the head rail 102 adjacent to the casing portion 120, and can be fixedly connected with the casing portion 120 of the winding unit 114. For facilitating assembly, the two casing portions 120 and 140 may be provided as separate parts that can be affixed with each other via fasteners. It will be appreciated, however, that the casing portions 120 and 140 may also be provided as an integral body.

The casing portion 140 can include a spring cavity 140A and a gear cavity 140B that are affixed with each other. The spring cavity 140A can receive the torsion spring 144. The gear cavity 140B can receive the central gear 142 and the planetary gears 148, and a sidewall 147 of the gear cavity 140B can be provided with an opening 151 for passage of the transmission axle 112. As shown, the gear cavity 140B can be arranged between the spring cavity 140A of the casing portion 140 and the casing portion 120 of the winding unit 114 along the longitudinal axis X. When the control system 110 is assembled, the transmission axle 112 respectively extends through the spring cavity 140A and the gear cavity 140B of the casing portion 140.

The ring 150 can be affixed with the gear cavity 140B of the casing portion 140. An inner edge of the ring 150 can have a plurality of projecting teeth 150A distributed around the transmission axle 112.

The central gear 142 is disposed in the gear cavity 140B near the side 122B of the rotary drum 122, passes through the opening 151 of the sidewall 147 and is pivotally connected with the gear cavity 140B of the casing portion 140. The transmission axle 112 extends through the central gear 142 and is fixedly connected with the central gear 142 in a coaxial manner, such that the central gear 142 is rotationally coupled with the transmission axle 112.

Referring to FIGS. 5 and 7, the torsion spring 144 is assembled in the spring cavity 140A and around the transmission axle 112. The torsion spring 144 can exemplary be a constant force spring having a first or inner end 144A (i.e., disposed radially near the transmission axle 112) and a second or outer end 144B (i.e., disposed radially away from the transmission axle 112). The torsion spring 144 winds around an axle sleeve 152, the first end 144A of the torsion spring 144 being affixed with the axle sleeve 152, and the second end 144B of the torsion spring 144 being affixed with an inner sidewall of the spring cavity 140A of the casing portion 140. Once the torsion spring 144 is assembled in the spring cavity 140A, the spring cavity 140A can be closed by a side cap 149.

The coupling member 146 is assembled around the transmission axle 112 in a coaxial manner, i.e., the coupling member 146 and the transmission axle 112 have a same axis. The coupling member 146 can include the axle sleeve 152 and a gear carrier 154 affixed with each other, the gear carrier 154 having a central hole 156. The axle sleeve 152 is disposed in the spring cavity 140A. The gear carrier 154 is disposed adjacent to the gear cavity 140B of the casing portion 140, and is affixed with the axle sleeve 152 through an opening 160 formed through a sidewall 158 of the spring cavity 140A. The gear carrier 154 and the axle sleeve 152 can be thereby rotationally coupled with each other. Since the first end 144A of the torsion spring 144 is operatively coupled with the gear carrier 154 via its connection to the axle sleeve 152, the first end 144A of the spring 144, the axle sleeve 152 and the gear carrier 154 can move in unison. Moreover, the gear cavity 140B can further be affixed with a stop collar 162 that is disposed adjacent to the gear carrier 154 for restrictedly positioning the coupling member 146 in the gear cavity 140B.

While the axle sleeve 152 and the gear carrier 154 are illustrated as individual parts affixed with each other, it is worth noting that the axle sleeve 152 and the gear carrier 154 may also be fabricated as an integral piece for forming the coupling member 146.

The gear carrier 154 can include a plurality of shaft portions 154A. The planetary gears 148 are respectively connected pivotally with the gear carrier 154 about the shaft portions 154A, so that the planetary gears 148 can rotate relative to the gear carrier 154. In one embodiment, the gear carrier 154 can be exemplary assembled with four planetary gears 148. It will be appreciated, however, that more or less planetary gears 148 may be suitable. The planetary gears 148 are distributed around the transmission axle 112, and are surrounded by the ring 150. The planetary gears 148 are respectively meshed with the central gear 142 and the teeth 150A of the ring 150. Accordingly, rotation of the transmission axle 112 and the central gear 142 can drive a rotational displacement of the coupling member 146 and the second end 144B of the torsion spring 144 in a same direction via the drive transmission of the planetary gears 148. Moreover, the tooth ratio between the central gear 142 and the teeth 150A of the ring 150 (e.g., the tooth ratio can be equal to 1:4) is such that the rotational displacement of the coupling member 146 and the second end 144B of the torsion spring 144 occurs at a speed slower than that of the transmission axle 112, thereby providing speed reduction.

The assembly of the central gear 142, the planetary gears 148 and the coupling member 146 comprised of the gear carrier 154 and the axle sleeve 152 can form a speed reducer operable to adapt a fixed working range of the torsion spring 144 to a greater displacement range of the bottom part 106, which can solve the problem of insufficient spring length. Once the spring drive unit 116 is assembled, the transmission axle 112 respectively passes through the rotary drum 122, the central gear 142, the axle sleeve 152 and the gear carrier 154 of the coupling member 146, the torsion spring 144 and the casing portions 120 and 140.

Exemplary operation of the window shade 100 and the control system 110 is described hereinafter with reference to FIGS. 1-8. When a user pulls the bottom part 106 downward, the spring force of the spring drive unit 116 can be overcome, and the suspension member 118 can unwind from the winding unit 114, which can drive the rotary drum 122, the transmission axle 112 and the central gear 142 to rotate synchronously. Because the planetary gears 148 are respectively meshed with the central gear 142 and the teeth 150A of the ring 150, the rotation of the transmission axle 112 and the central gear 142 can drive a rotational displacement of the coupling member 146 (including the axle sleeve 152 and the gear carrier 154) and the second end 144B of the torsion spring 144 at a differential speed. More specifically, the unison displacement of the gear carrier 154, the axle sleeve 152 and the torsion spring 144 can occur at a speed slower than the rotation speed of the transmission axle 112 and the central gear 142. For example, when the rotary drum 122, the transmission axle 112 and the central gear 142 rotate multiple turns, the second end 144B of the torsion spring 144 and the coupling member 146 correspondingly rotate only one turn.

When the bottom part 106 has reached a desired position, the user can release the bottom part 106. As a result, the spring force applied by the spring drive unit 116, the suspended weight applied on the suspension members 118, and internal friction forces of the control system 110 can counteract one another to sustain the bottom part 106 in position. In other words, the spring force exerted by the torsion spring 144 in the spring drive unit 116 can assist in keeping the bottom part 106 in position.

When the user pushes the bottom part 106 upward, owing to the connection of the coupling member 146, the planetary gears 148 and the central gear 142, the spring force of the spring drive unit 116 can drive rotation of the transmission axle 112 and the rotary drum 122 for winding the suspension member 118. Moreover, the second end 144B of the torsion spring 144 moves at a speed that is slower than that of the transmission axle 112 and the central gear 142 due to the speed reducer.

The window shade described herein includes a speed reducer that can adapt a fixed working range of a torsion spring to a greater displacement range of a bottom part of the window shade, thereby solving the problem of insufficient spring length. With the speed reducer, a same spring drive unit may be suitable for use with different sizes of window shades. Moreover, the spring drive unit and the winding unit can be connected with each other in close proximity so as to reduce the assembly space.

Realizations of the structures have been described only in the context of particular embodiments. These embodiments are meant to be illustrative and not limiting. Many variations, modifications, additions, and improvements are possible. Accordingly, plural instances may be provided for components described herein as a single instance. Structures and functionality presented as discrete components in the exemplary configurations may be implemented as a combined structure or component. These and other variations, modifications, additions, and improvements may fall within the scope of the claims that follow.

What is claimed is:

1. A control system for a window shade, comprising:

a suspension member;

a first and a second casing portion;

a rotary drum pivotally connected with the first casing portion and affixed with the suspension member, the rotary drum being rotatable to wind and unwind the suspension member;

a torsion spring operable to bias the rotary drum in rotation for winding the suspension member, the torsion spring having a first and a second end, the second end being affixed with the second casing portion;

a coupling member affixed with the second end of the torsion spring, the coupling member including a gear carrier and an axle sleeve affixed with each other, the torsion spring winding around the axle sleeve with the first end of the torsion spring affixed with the axle sleeve;

a transmission axle disposed through the torsion spring, the transmission axle being rotationally coupled with the rotary drum;

a central gear rotationally coupled with the transmission axle;

a ring affixed with the second casing portion and having a plurality of teeth; and a plurality of planetary gears respectively connected pivotally with the gear carrier of the coupling member, the planetary gears being respectively meshed with the central gear and the teeth of the ring, wherein the gear carrier, the axle sleeve and the first end of the torsion spring are movable in unison at a speed different from a rotation speed of the transmission axle.

2. The control system according to claim 1, wherein the coupling member is rotatable at a speed slower than that of the rotary drum.

3. The control system according to claim 1, wherein the transmission axle is fixedly connected with the central gear in a coaxial manner.

4. The control system according to claim 1, wherein the second casing portion has a sidewall, and the central gear is pivotally connected with the second casing portion through the sidewall.

5. The control system according to claim 1, wherein the transmission axle respectively extends through the central gear and the coupling member.

6. The control system according to claim 1, wherein the transmission axle respectively extends through the central gear, the gear carrier and the axle sleeve.

7. The control system according to claim 6, wherein while the transmission axle and the central gear rotate synchronously, the gear carrier and the axle sleeve rotate at a relatively slower speed.

8. The control system according to claim 1, wherein the first and second casing portions are adjacent to each other.

9. The control system according to claim 8, wherein the second casing portion includes a spring cavity and a gear cavity, the torsion spring being received in the spring cavity, the central gear and the planetary gears being received in the gear cavity, and the gear cavity being located between the spring cavity and the first casing portion.

10. The control system according to claim 1, wherein the rotary drum has a first and a second side opposite to each other, the second side being located near the central gear, the suspension member being affixed with the rotary drum near the first side and winding around an outer surface of the rotary drum from the second side toward the first side.

11. A window shade comprising:

a head rail, a bottom part, and a shading structure disposed between the head rail and the bottom part; and the control system according to claim 1, being disposed in the head rail, the suspension member of the control system having a first and a second end respectively affixed with the rotary drum and bottom part.

12. The window shade according to claim 11, wherein the torsion spring biases the rotary drum in rotation for winding the suspension member when the bottom part rises toward the head rail.

13. The window shade according to claim 11, wherein the torsion spring applies a spring force for assisting in keeping the bottom part stationary at any position below the head rail.

14. A control system for a window shade, comprising:

a suspension member;

a first and a second casing portion;

a rotary drum pivotally connected with the first casing portion and affixed with the suspension member, the rotary drum being rotatable to wind and unwind the suspension member;

a torsion spring assembled coaxial to the transmission axle and operable to bias the rotary drum in rotation for winding the suspension member, the torsion spring having a first and a second end, the second end being affixed with the second casing portion;

a transmission axle passing through the torsion spring, the transmission axle being rotationally coupled with the rotary drum; and a speed reducer respectively connected with the transmission axle and the first end of the torsion spring, the speed reducer including a plurality of gears configured to convert rotational movement of the transmission axle and the rotary drum to a slower displacement of the first end of the torsion spring, wherein the speed reducer includes:

a central gear fixedly connected with the transmission axle in a coaxial manner;

a ring affixed with the second casing portion and having a plurality of teeth;

a gear carrier and an axle sleeve affixed with each other, the first end of the torsion spring being affixed with the axle sleeve; and a plurality of planetary gears respectively connected pivotally with the gear carrier, the planetary gears being respectively meshed with the central gear and the teeth of the ring;

wherein the gear carrier and the axle sleeve are rotatable at a speed slower than that of the transmission axle and the rotary drum.

15. The control system according to claim 14, wherein the second casing portion has a sidewall, and the central gear is pivotally connected with the second casing portion through the sidewall.

16. The control system according to claim 14, wherein the transmission axle respectively extends through the central gear, the gear carrier and the axle sleeve.

17. A window shade comprising:

a head rail, a bottom part, and a shading structure disposed between the head rail and the bottom part; and the control system according to claim 14, being disposed in the head rail, the suspension member of the control system having a first and a second end respectively affixed with the rotary drum and bottom part, wherein the torsion spring applies a spring force that biases the rotary drum in rotation for winding the suspension member when the bottom part rises toward the head rail.

* * * * *